United States Patent [19]

Ahmer

[11] 4,026,047

[45] May 31, 1977

[54] DECORATIVE DEVICE FOR CONVERTING STREET SHOES TO DRESS SHOES

[76] Inventor: Joseph C. Ahmer, 5349½ E. Carson, Long Beach, Calif. 90808

[22] Filed: July 30, 1976

[21] Appl. No.: 709,967

[52] U.S. Cl. ..... 36/136; D2/315; 2/245

[51] Int. Cl.[2] ..... A43B 23/00

[58] Field of Search ..... 36/136; 2/245; D2/315

[56] References Cited

UNITED STATES PATENTS

| | | | |
|---|---|---|---|
| 1,640,104 | 8/1927 | Ballou et al. | 2/245 X |
| 1,668,480 | 5/1928 | Ballou et al. | 2/245 X |
| 1,977,995 | 10/1934 | Morali | 36/136 X |
| 2,461,977 | 2/1949 | Gilmour | D2/315 X |
| 2,759,284 | 8/1956 | Santisi | 36/136 X |

*Primary Examiner*—Alfred R. Guest
*Attorney, Agent, or Firm*—Harvey C. Nienow

[57] ABSTRACT

A decorative device for converting street shoes to dress or evening shoes, comprising a mounting tab which fits within the shoe at the rear thereof and from which there is provided depending decorative links of a chain which may be provided with jewels or sequins. A flexible connector is provided at the lower end of the decorative links to encircle the heel of the shoe to thereby anchor the decorative means in place, irrespective of the size of the heel of the shoe. The flexible connector includes metal links which are joined together by springs in the form of a stretch band.

8 Claims, 4 Drawing Figures

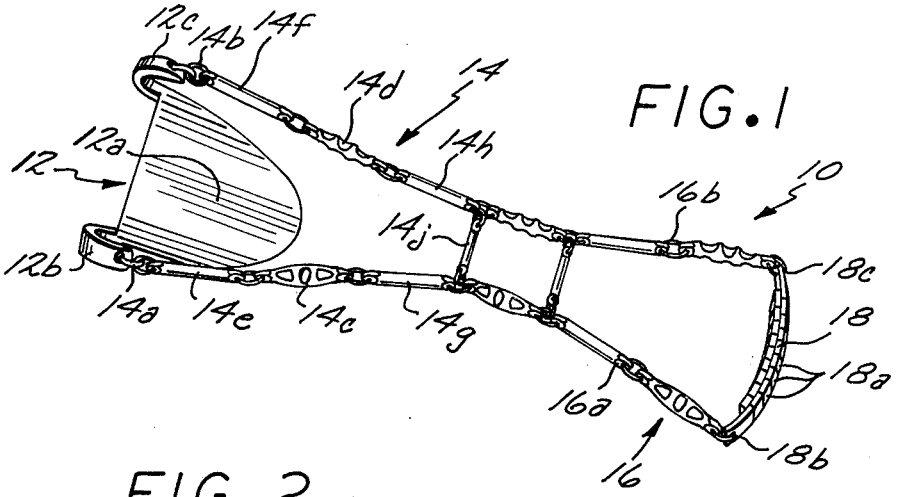
FIG. 1
FIG. 2
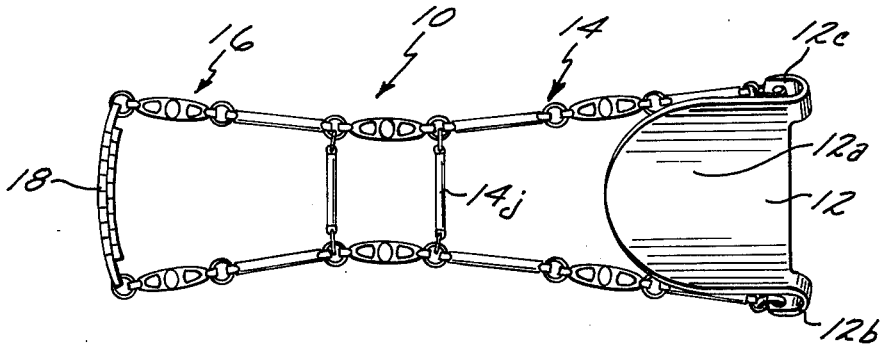
FIG. 3
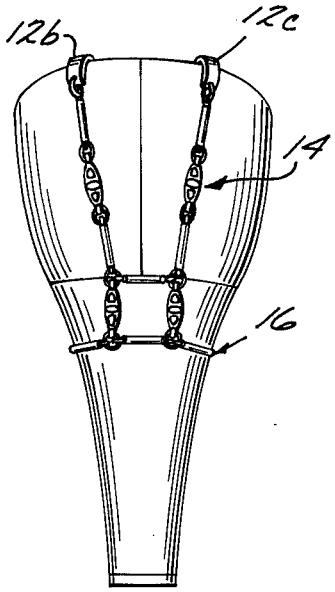
FIG. 4
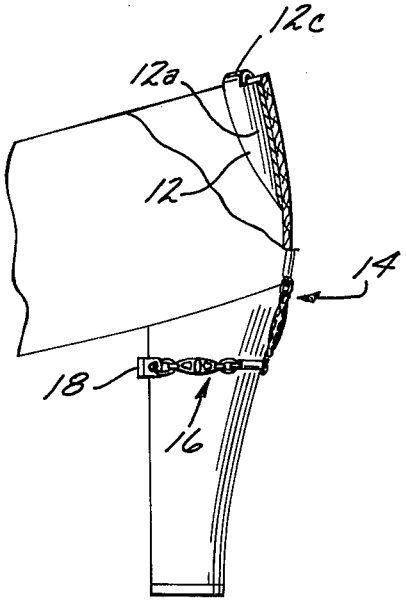

DECORATIVE DEVICE FOR CONVERTING STREET SHOES TO DRESS SHOES

The present invention relates generally to decorative devices for converting street shoes to dress shoes, but more particularly to means whereby street shoes are provided with jewels and the like for evening wear.

It is relatively costly today to provide a lady with all of the necessary footwear for engaging in sports or ordinary street wear as well as elegant footwear for evening purposes. Frequently, the only noticeable difference between ladies' street shoes and ladies' evening shoes is the kind and amount of adornments such as costume jewels and the like which are found on evening shoes but which are not found on ordinary street shoes. Accordingly, it has been realized for some period of time that it would be desirable to have means for converting ordinary street shoes into dress or evening shoes by providing the necessary decorative means which could be applied to or removed from a given pair of shoes, as desired.

Such a need has been particularly acute on ladies' vacation trips and the like. Under such circumstances, it is not always convenient to have many different types of shoes available, so that it is particularly desirable to be able to convert a given pair of shoes from one purpose to another.

In view of the foregoing, it is an object of the present invention to provide a decorative device which can be used to quickly and easily convert a pair of shoes from street wear to evening wear.

A further object of the present invention is to provide a decorative device as characterized above which comprises means which can be provided with decorative stones or jewels as desired.

A still further object of the present invention is to provide a decorative conversion device as characterized above which can be firmly anchored to the rear of a lady's shoe so as to remain in place throughout ordinary evening activities.

An even still further object of the present invention is to provide a decorative conversion device as characterized above which includes a flexible connector which can vary considerably so as to accomodate any heel size within a given range thereof.

An even further object of the present invention is to provide a decorative conversion device as characterized above which is simple and inexpensive to manufacture and which is rugged and dependable in operation.

The novel features which I consider characteristic of my invention are set forth with particularity in the appended claims. The invention itself, however, both as to its organization and mode of operation, together with additional objects and advantages thereof, will best be understood from the following description of specific embodiments when read in connection with the accompanying drawings, in which:

FIG. 1 is a plan view of a conversion device according to the present invention;

FIG. 2 is another plan view thereof;

FIG. 3 is a rear elevational view of such conversion device as mounted on a shoe; and FIG. 4 is a fragmentary sectional view showing the device.

Like reference characters indicate corresponding parts throughout the several views of the drawing.

Referring to FIG. 1 of the drawings, there is shown therein a decorative conversion device 10 according to the present invention. It includes a mounting tab 12, decorative means 14 and a flexible connector 16.

Mounting tab 12 may be formed of any appropriate material such as metal, plastic or the like, and is provided with an arcuately shaped main body **12*a* and one or more reversely bent mounting portions as shown at 12*b* and 12*c*. The main body 12*a* is provided with an arcuate shape to conform to the inner curvature of the rear of a lady's shoe, and the reversely bent portions 12*b* and 12*c* are to fit over the upper rear edge of such shoe. If formed of plastic, the mounting tab 12 may be formed in mass-production methods with the proper curvature. If formed of metal, such main body 12*a*** can be shaped in an appropriate press or forming operation.

The decorative means 14 is connected to the reversely bent portions **12*b* and 12*c* by appropriate links as shown at 14*a* and 14*b*. The other portions of the decorative means 14 include links, as shown at 14*c* and 14*d*, which are painted decorative colors. Certain links such as those shown at 14*e*, 14*f*, 14*g* and 14*h* may be highly polished. A cross member such as shown at 14*j*** is operable to hold the several strands of links in proper relation.

The flexible connector 16 includes side portions **16*a* and 16*b* as well as a flexible or stretch band 18. The side portions 16*a* and 16*b*** are formed of any appropriate links of decorative material, including members having stones or jewels embedded therein, or the like.

The stretch bank 18 is formed of individual decorative links as shown at **18*a* which are interconnected by suitable tension springs (not shown). The links 18*a* are constantly urged to adjacent relationship by such tension springs, but can be separated, to expand the entire band 18, by suitable forces applied to the opposite ends 18*b* and 18*c* of stretch band 18. Such opposite ends are connected to the legs 16*a* and 16*b* of the flexible connector 16**.

As shown most particularly in FIGS. 3 and 4 of the drawings, the decorative conversion device of FIGS. 1 and 2 is mounted on a shoe by placing the flexible connector 16 about the heel of the shoe and thereafter pivoting the mounting tab 12 into the heel of the shoe, with the reversely bent portions **12*b* and 12*c* in engagement with the upper edge of the rear of the shoe. The decorative means 14 is thus positioned vertically along the rear of the shoe, the upper portion thereof being connected to the reversely bent portions 12*b* and 12 *c* and the lower or depending end portion thereof being connected to the flexible connector 16**.

The flexible connector serves various functions. Firstly, it accomodates shoe heels of different size and shape, the stretch band 18 permitting the connector 16 to expand or contract as necessary to fit and conform to any heel within a certain range of sizes. Secondly, the stretch band 18 enables the arcuate mounting tab to be pushed upwardly and into the heel of the shoe, thereafter to maintain the decorative means in firm engagement with the back of the shoe as shown in FIGS. 3 and 4 of the drawings. Also, the stretch band 18 is decorative so as to add to the attractiveness of the conversion device in converting a pair of ladie's street shoes to evening wear.

The reverse procedure, namely to firstly remove the mounting tab 12 from within the shoe and thereafter to remove the flexible connector from around the heel, enables the shoe to be reconverted to street wear.

It is thus seen that the present invention provides a decorative conversion device for converting ladies' shoes from street wear to evening wear, and again back to street wear, as desired.

Although I have shown and described a specific embodiment of my invention, I am well aware that many modifications thereof are possible. Accordingly, it should not be restricted except insofar as is necessitated by prior art and by the language of the appended claims.

I claim:

1. Decorative device for converting street shoes to dress shoes, comprising in combination, a mounting tab insertable into a shoe at the rear thereof, decorative means having one end connected to said mounting tab and another end in depending relation thereto, and a flexible connector to be positioned about the heel of said shoe and connected to said other end of said decorative means to retain the latter against the back of the shoe.

2. Decorative device for converting street shoes to dress shoes, according to claim 1, wherein said flexible connector encircles said shoe heel and is formed of metal links interconnected with springs to accomodate heels of different sizes.

3. Decorative device for converting street shoes to dress shoes, according to claim 2, wherein said mounting tab is formed with an arcuately shaped main body to fit within and against the rear of said shoe.

4. Decorative device for converting street shoes to dress shoes, according to claim 3, wherein said mounting tab is further formed with a reversely bent portion engageable with the upper rear edge of the shoe to retain the tab in place.

5. Decorative device for converting street shoes to dress shoes, according to claim 4, wherein said decorative means is connected to said reversely bent portion.

6. Decorative device for converting street shoes to dress shoes, according to claim 5, wherein said mounting tab is formed with two reversely bent portions and said decorative means is connected to both of said portions.

7. Decorative device for converting street shoes to dress shoes, according to claim 6, wherein said decorative means comprises decorative links provided with decorative material thereon.

8. Decorative device for converting street shoes to dress shoes, according to claim 7, wherein said metal links of said flexible connector are provided with decorations to provide a flexible band of similar decorative links.

* * * * *